US012490814B2

(12) United States Patent
Sho et al.

(10) Patent No.: US 12,490,814 B2
(45) Date of Patent: Dec. 9, 2025

(54) SLIDE FASTENER AND SLIDE FASTENER-ATTACHED PRODUCT

(71) Applicant: YKK Corporation, Tokyo (JP)

(72) Inventors: Yoshiyuki Sho, Toyama-ken (JP); Nao Yasuda, Toyama-ken (JP); Takayoshi Tanaka, Toyama-ken (JP); Tomoya Kaido, Toyama-ken (JP); Yoshifumi Nakata, Toyama-ken (JP); Yutaka Sunagawa, Toyama-ken (JP); Kazuki Katsuki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 15 days.

(21) Appl. No.: 18/735,598

(22) Filed: Jun. 6, 2024

(65) Prior Publication Data

US 2025/0031810 A1 Jan. 30, 2025

(30) Foreign Application Priority Data

Jul. 24, 2023 (JP) ..... 2023-002629 U

(51) Int. Cl.
*A44B 19/08* (2006.01)

(52) U.S. Cl.
CPC ..... *A44B 19/08* (2013.01)

(58) Field of Classification Search
CPC ..... A44B 19/08; A44B 19/26
See application file for complete search history.

(56) References Cited

U.S. PATENT DOCUMENTS

| | | | | |
|---|---|---|---|---|
| 1,681,550 | A * | 8/1928 | Marinsky | A44B 19/26 24/429 |
| 1,893,420 | A * | 1/1933 | Lacher | A44B 19/34 383/97 |
| 2,862,274 | A * | 12/1958 | Morin | A44B 19/26 24/427 |
| 5,081,747 | A * | 1/1992 | Takizawa | A44B 19/26 24/415 |
| 2012/0246886 | A1 | 10/2012 | Matsumoto et al. | |
| 2014/0150216 | A1 * | 6/2014 | Fukuyama | A44B 19/60 72/338 |
| 2019/0357638 | A1 * | 11/2019 | Sho | A44B 19/28 |

FOREIGN PATENT DOCUMENTS

WO 2011/064893 A1 6/2011

* cited by examiner

*Primary Examiner* — David M Upchurch
(74) *Attorney, Agent, or Firm* — Kilpatrick Townsend & Stockton LLP

(57) ABSTRACT

A slide fastener with which a slide fastener-attached product capable of preventing or suppressing exposure of a fastener tape can be manufactured is provided. The slide fastener includes fastener stringers and a slider, in which each of fastener elements includes an element base portion and a fin portion extending from the element base portion toward a tape inner side of a fastener tape and having a smaller dimension in a tape thickness direction than the element base portion, in which, at a shoulder-port-side end portion of a slider body, a leading end portion of the fin portion of each of the fastener elements is positioned on the outer side of the slider body with respect to an inner wall surface of a flange, and in which the ratio of a total fin width to an element maximum width is less than 40%.

8 Claims, 7 Drawing Sheets

SLIDE FASTENER AND SLIDE FASTENER-ATTACHED PRODUCT

TECHNICAL FIELD

The present invention relates to a slide fastener and a slide fastener-attached product.

BACKGROUND ART

For example, International Publication No. 2011/064893 (PTL 1) describes a slide fastener having watertightness. In short, the slide fastener described in PTL 1 includes a pair of left and right fastener stringers in each of which an element row is formed, and a slider that is attached to the element rows on the left side and the right side to be slidable.

Each of the left and right fastener stringers includes a fastener tape (tape member) and a plurality of fastener elements that are provided at a tape side edge portion of the fastener tape. The fastener tape includes a waterproof moisture-permeable thin tape body and a core string portion that is provided at a tape side edge portion of the tape body. The fastener tape also has a property that suppresses infiltration of a liquid from the tape front surface side to the tape back surface side of the fastener tape.

CITATION LIST

Patent Literature

PTL 1: International Publication No. 2011/064893

SUMMARY OF INVENTION

Technical Problem

When the slide fastener described in PTL 1 mentioned above is to be attached to, for example, a product such as a garment or a bag, in a state in which, for example, a fastener tape of a fastener stringer and a fastener-receiving member (for example, a fabric of a garment) of the product are placed to overlap each other, the fastener tape and the fastener-receiving member are sewed by a sewing machine.

In existing sewing, generally, the fastener tape and a fastener attachment edge portion are sewed together by being introduced into a space between a needle plate and a sewing-machine presser foot of the sewing machine in a state in which the fastener tape and a fastener attachment portion of the fastener-receiving member are placed to overlap each other. In this case, in consideration of the positional relationship of the sewing-machine presser foot and a sewing-machine needle with respect to fastener elements of the fastener stringer during sewing, the sewing-machine needle of the sewing machine is required to be caused to reciprocate upward and downward at a position away from the fastener elements of the fastener tape in a tape width direction to pierce the fastener tape. As a result, a sewing portion formed by a sewing thread with which the fastener tape and the fastener-receiving member are sewed together is formed at a position away from the fastener elements in the tape width direction, and the fastener tape is thus disposed between the fastener elements and the fastener-receiving member to be exposed to the outside.

Meanwhile, in some products to which a slide fastener is attached, the slide fastener is also seen as one of elements of design of the products. Therefore, there has been a demand for a fastener tape of a slide fastener not to be seen or not to be easily seen to improve design characteristics or external appearance quality of a slide fastener-attached product.

The present invention has been made in consideration of the issue described above, and an object of the present invention is to provide a slide fastener with which a slide fastener-attached product capable of preventing or suppressing exposure of a fastener tape between fastener elements and a fastener-receiving member can be manufactured, and a slide fastener-attached product that is manufactured by using the slide fastener.

Solution to Problem

To achieve the aforementioned object, a slide fastener according to the present invention is a slide fastener including a pair of fastener stringers in each of which a plurality of fastener elements are provided at a fastener tape to form an element row; and a slider that is attached to the element rows to be slidable, in which the slider includes a slider body, the slider body including an upper wing plate and a lower wing plate that are disposed to be separated from each other, a coupling column that couples the upper wing plate and the lower wing plate to each other, and a flange that extends from a side edge portion of at least one of the upper wing plate and the lower wing plate, in which the slider body is provided with an element guide passage that is formed into a Y-shape between the upper wing plate and the lower wing plate, a pair of shoulder ports that are each provided at a side of the coupling column such that the coupling column is interposed between the pair of shoulder ports, and an insertion gap that is provided at a side edge portion of the slider body and that is in communication with the element guide passage, in which each of the fastener elements includes an element base portion including a portion whose dimension in a tape thickness direction of the fastener tape is constant, and a fin portion extending from the element base portion toward a tape inner side of the fastener tape and having a smaller dimension in the tape thickness direction than the element base portion through a step portion, in which when, at a shoulder-port-side end portion of the slider body with the element guide passage into which the element rows are inserted, a cross-section orthogonal to a tape length direction of the fastener tape is viewed, a leading end portion of the fin portion is positioned on an outer side of the slider body with respect to an inner wall surface of the flange in a state in which a side surface of the element base portion of each of the fastener elements, the side surface facing outward in a left-right direction, is not in contact with the inner wall surface of the flange of the slider, and in which, in a state in which a pair of the element rows are engaged with each other, when a maximum value of a dimension of two of the fastener elements that are engaged with each other in a tape width direction of the fastener tape is defined as an element maximum width and a total of dimensions of the fin portions of the two of the fastener elements in the tape width direction is defined as a total fin width, a ratio of the total fin width to the element maximum width is less than 40%.

In the slide fastener according to the present invention, when, at the shoulder-port-side end portion of the slider body, the cross-section orthogonal to the tape length direction of the fastener tape is viewed, the leading end portion of the fin portion is preferably positioned the an outer side of the slider body with respect to a center position of the flange in the tape width direction in the state in which the side surface of the element base portion of each of the fastener elements, the side surface facing outward in the left-right direction, is not in contact with the inner wall surface of the flange of the slider.

In addition, a dimension of the fin portion in the tape length direction preferably gradually decreases toward the leading end portion of the fin portion.

Further, a dimension of a base end portion of the fin portion in the tape length direction is preferably smaller than a dimension of a side edge portion of the element base portion in the tape length direction, the side edge portion being on a side to which the fin portion is connected.

Furthermore, a dimension of the fin portion in the tape thickness direction of the fastener tape preferably gradually decreases toward the leading end portion of the fin portion.

Next, according to the present invention, there is provided a slide fastener-attached product including the slide fastener that has the above-described configuration, and a fastener-receiving member, in which the fastener stringers are attached to a stringer attachment edge portion by a sewing portion formed by a sewing thread.

In the slide fastener-attached product according to the present invention, the stringer attachment edge portion preferably includes a double portion that is folded into a U-shape in a sectional view orthogonal to the tape length direction, the double portion in the sectional view preferably includes a first strip portion, at least a portion of which is in contact with the fastener tape, a fold portion that extends from the first strip portion and that has a folded shape, and a second strip portion that extends from the fold portion and that is disposed to overlap the first strip portion, a portion of the sewing portion is preferably disposed to be interposed between the first strip portion and the second strip portion of the double portion, and the double portion is preferably fixed, at a position at which the double portion is in contact with at least a portion of each of the fastener elements, to the fastener tape by the sewing portion.

In addition, a dimension of the double portion in the tape thickness direction is preferably larger than a dimension of a space of the insertion gap of the slider.

Advantageous Effects of Invention

According to the slide fastener of the present invention, when a slide fastener-attached product is manufactured, exposure of a fastener tape of the slide fastener-attached product between a fastener-receiving member and fastener elements can be prevented or suppressed.

DESCRIPTION OF EMBODIMENTS

Regarding a slide fastener-attached product in which a fastener stringer is attached to a stringer attachment edge portion of a fastener-receiving member by sewing, the present inventers have found that it is possible to hold a fold portion of the stringer attachment edge portion and fastener elements to be in contact with each other by forming a sewing portion of a sewing thread so as to be in contact with a portion of each of the fastener elements and by pressing the position of the fold portion of the stringer attachment edge portion by the sewing portion and that it is thus possible to prevent or suppress exposure of a fastener tape between the fastener-receiving member and the fastener elements.

Meanwhile, it has been found that, when a fold portion of a stringer attachment edge portion is pressed by a sewing portion to be in contrast with fastener elements in a slide fastener-attached product such as that described above, the stringer attachment edge portion comes into contact with a slider of a slide fastener at the time of sliding of the slider and easily causes the stringer attachment edge portion to be caught and engaged by the slider and, as a result, causes inconvenience in which operability of the slider is deteriorated.

The present inventers have further studied and examined the above matters intensively and, as a result, found that it is possible to prevent or suppress exposure of a fastener tape and prevent deterioration in the operability of a slider by providing each fastener element with a fin portion that is insertable into an insertion gap of the slider and setting the size (specifically, the size in the tape width direction) of the fin portion properly, and have completed the present invention.

Hereinafter, suitable embodiments of the present invention will be described in detail with reference to the drawings by presenting examples.

Example 1

Figure 1:
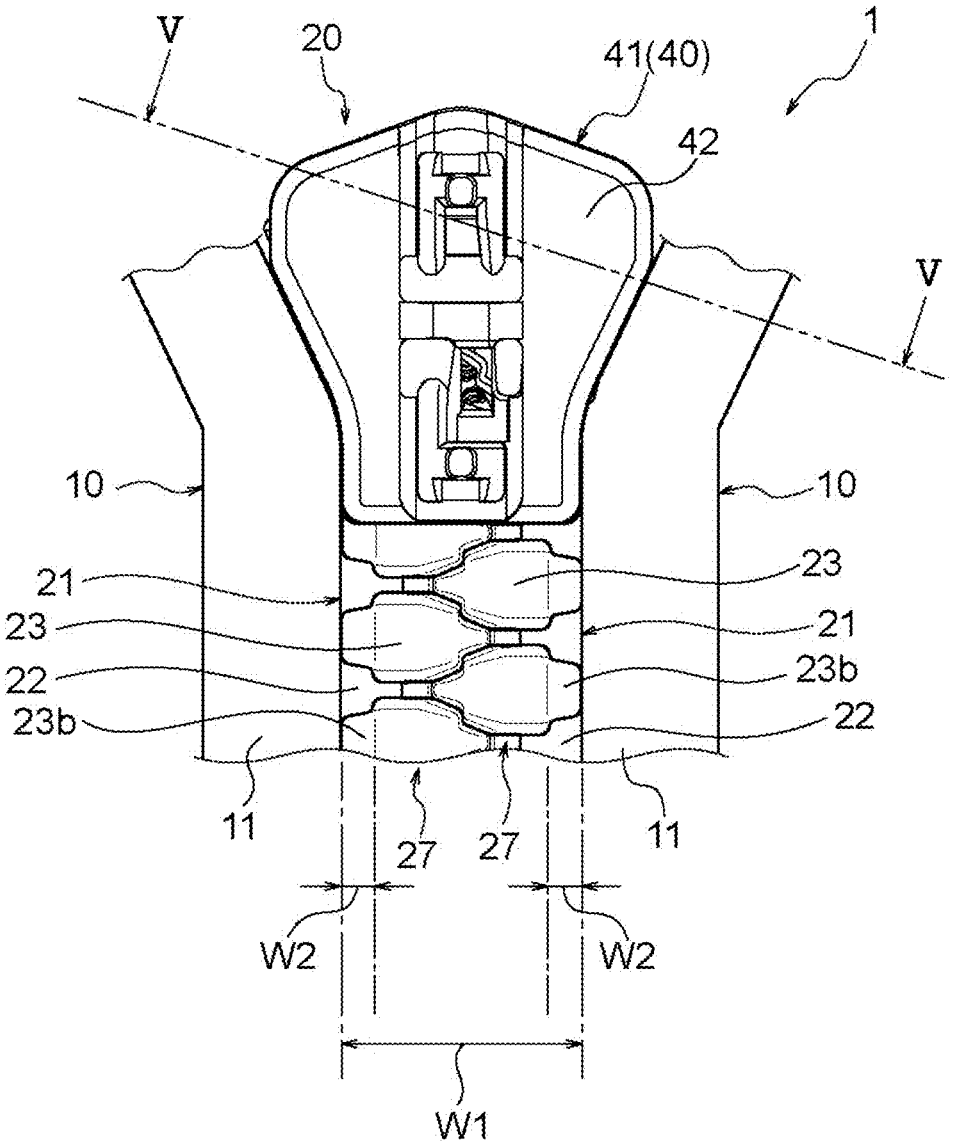
FIG. 1 is a plan view in which principal part of a slide fastener-attached product according to an example 1 of the present invention is schematically illustrated.
Figure 2:
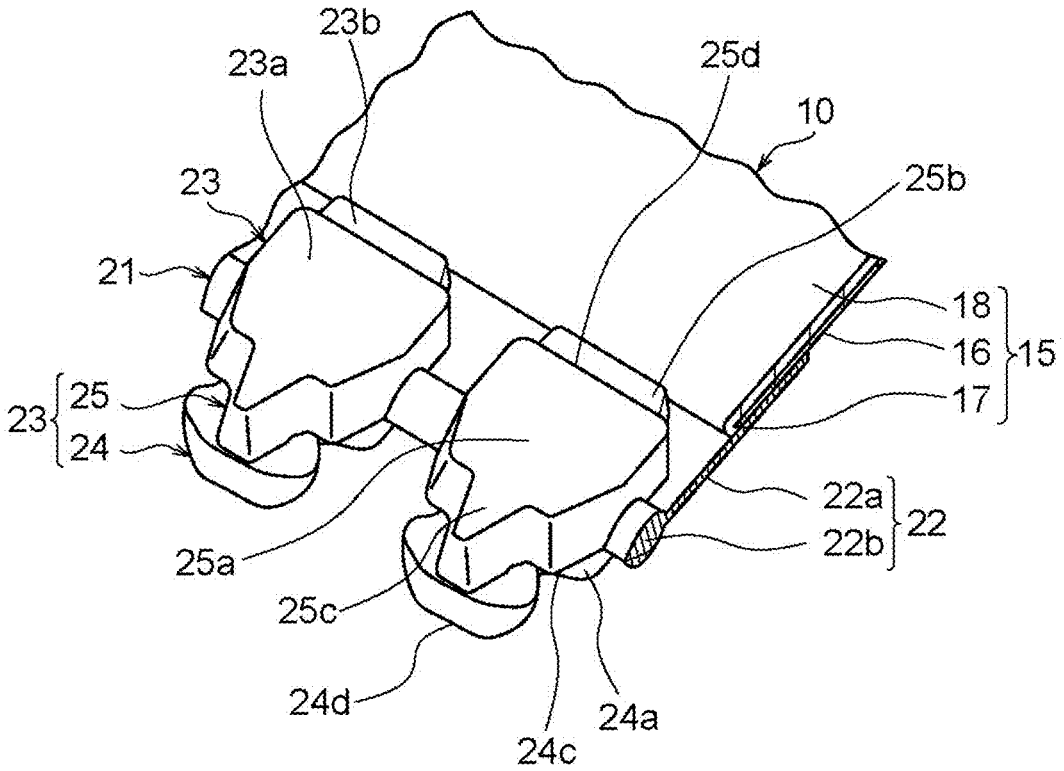
FIG. 2 is a perspective view in which part of a fastener stringer used in the slide fastener-attached product illustrated in FIG. 1 is enlarged and schematically illustrated.
Figure 3:
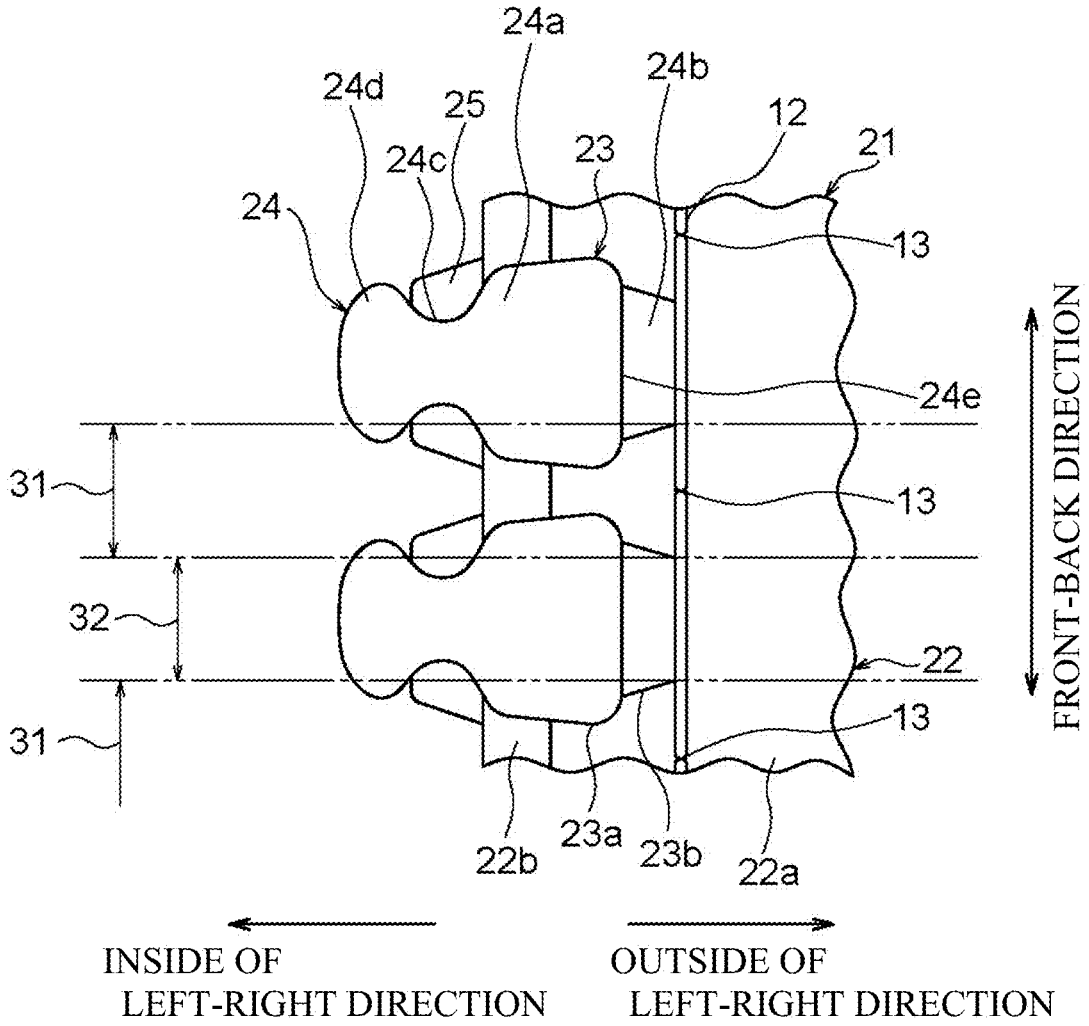
FIG. 3 is a bottom view in which part of the fastener stringer illustrated in FIG. 2 is schematically illustrated.
Figure 4:
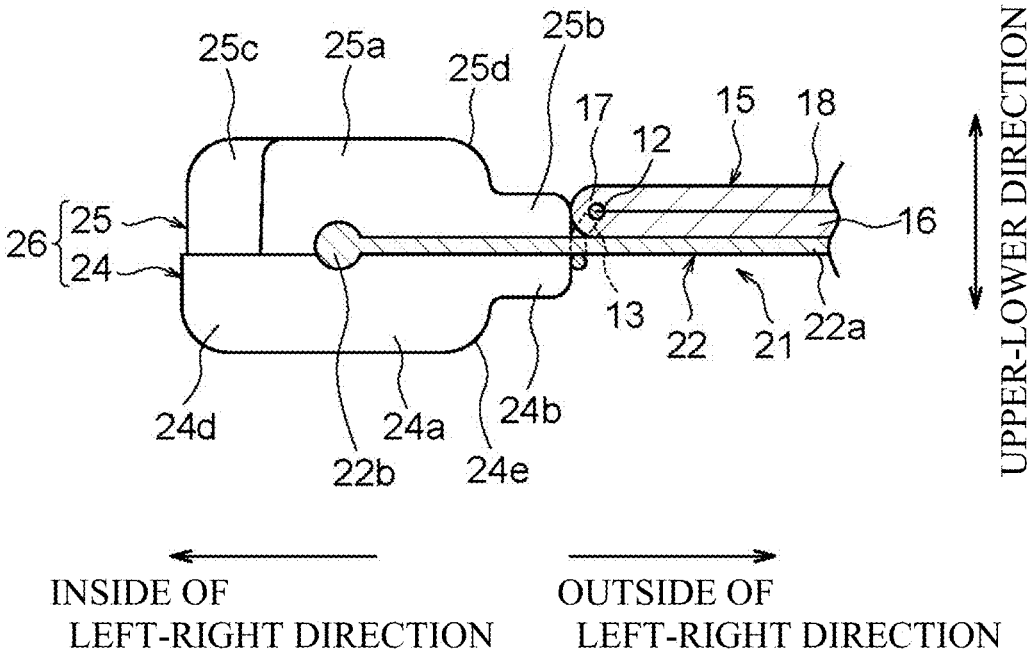
FIG. 4 is a sectional view in which a cross-section of the fastener stringer illustrated in FIG. 2 is schematically illustrated.
Figure 5:
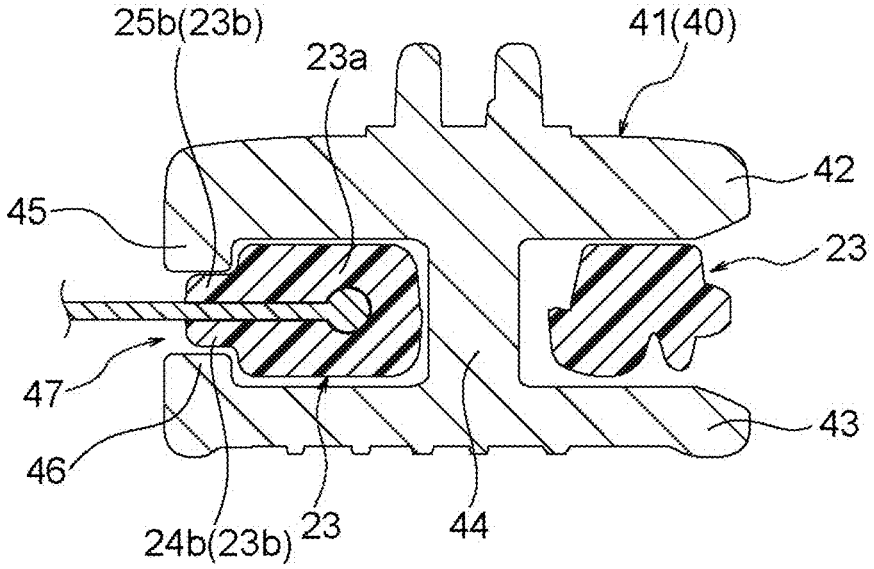
FIG. 5 is a sectional view in which a cross-section along line V-V indicated in FIG. 1 is schematically illustrated.

FIG. 1 is a plan view in which principal part of a slide fastener-attached product according to the present example 1 is schematically illustrated. FIG. 2 and FIG. 3 are a perspective view and a bottom view, respectively, in each of which part of a fastener stringer according to the present example 1 is enlarged and schematically illustrated. FIG. 4 is a sectional view in which a cross-section of the fastener stringer according to the present example 1 is schematically illustrated. FIG. 5 is a sectional view along line V-V indicated in FIG. 1.

In the following description of a slide fastener and a slide fastener-attached product, the front-rear direction refers to a direction along the tape length direction of a fastener tape and is a direction identical to a sliding direction in which a slider slides (see FIG. 1 and FIG. 2). Specifically, a direction in which the slider is slid to close the slide fastener is a forward direction, and a direction in which the slider is slid to open the slide fastener is a rearward direction.

The left-right direction refers to a direction along the tape width direction of the fastener tape and is, specifically, a direction that is orthogonal to the front-rear direction and that is parallel to the tape front surface and the tape back surface of the fastener tape. In addition, it can be said that the left-right direction is a direction along a direction in which element rows of a pair of fastener stringers are engaged with and separated from each other. In this case, a direction in which the pair of element rows move to approach each other is the inward direction in the left-right direction, and a direction in which the pair of element rows move to separate from each other is the outward direction in the left-right direction (see FIG. 3).

The up-down direction refers to a direction along a direction (the tape front-back direction or the tape thickness direction) orthogonal to the tape front surface and the tape back surface of the fastener tape and is a direction orthogonal to the front-rear direction and the left-right direction (see FIG. 4). Specifically, a direction (for example, the direction in which a pull of the slider is disposed with respect to the fastener tape) in which the slide fastener is exposed to the outside when used is the upward direction, and a direction opposite thereto is the downward direction.

A slide fastener-attached product 1 in the present example 1 is a garment (clothing item), and a slide fastener 20 is attached to, for example, a front open portion of the front part of this garment 1 or an openable portion (opening peripheral portion) of a pocket portion provided at a chest portion or a waist portion of the front part. This slide fastener-attached garment 1 includes the slide fastener 20 that has a pair of left and right fastener stringers 21, and a fastener-receiving member 10 that includes left and right stringer attachment edge portions 11 to which the left and right fastener stringers 21 are attached, respectively.

In the present example 1, the fastener-receiving member 10 to which the slide fastener 20 is attached is a fabric 10 (also referred to as a garment fabric) of the garment 1. In addition, each of the fabrics 10 that are on the left side and the right side and that that form the front part of the garment 1 has a fabric body portion (not illustrated) and a facing side edge portion that is disposed to face the other fabric 10 on the other side.

The facing side edge portion of each of the fabrics 10 on the left side and the right side is formed as the stringer attachment edge portion 11 to which the fastener stringer 21 of the slide fastener 20 is attached, and is integrally provided at an edge portion of the fabric body portion. The fastener stringer 21 is attached to the stringer attachment edge portion 11 of the fabric 10 by a sewing portion 12 that is formed by a sewing thread (sewing machine thread).

The stringer attachment edge portion 11 of each fabric 10 has a double portion 15 that is formed by the fabric 10 of the garment 1 overlapping in the up-down direction. The double portion 15 of this stringer attachment edge portion 11 is formed into a U-shape in a sectional view orthogonal to the front-rear direction as a result of the fabric 10 of the garment 1 being folded back at a fold portion 17 extending in the front-rear direction. In this case, the double portion 15 is in contact with fin portions 23*b* (second fin portions 25*b*, which are described later) of fastener elements 23, which are described later.

In a sectional view orthogonal to the front-rear direction, the double portion 15 includes a first strip portion 16 including at least portion in contact with a fastener tape 22, which is described later, of the fastener stringer 21; the fold portion 17 extending from the first strip portion 16 and having a folded shape; and a second strip portion 18 extending from the fold portion 17 and overlapping the first strip portion 16 in the up-down direction.

At this double portion 15, the first strip portion 16 is fixed to the fastener tape 22 by the sewing portion 12. The first strip portion 16 is disposed between the fastener tape 22 and the second strip portion 18 in the up-down direction. The second strip portion 18 is disposed on the first strip portion 16 to be separated from the fastener tape 22 of the fastener stringer 21 and disposed to extend inward in the width direction from the fabric body portion (not illustrated) of the fabric 10. Note that an adhesive, an adhesive sheet, or the like may be provided between the fastener tape 22 and the fabric 10 so as not to be in contact with the fastener elements 23.

The fold portion 17 of the double portion 15 is formed by the fabric 10 being folded at the position of the sewing portion 12 with which the fastener tape 22 is sewed to be attached to the stringer attachment edge portion 11 of the fabric 10. A portion of the sewing portion 12 is wrapped and held on the inner side of this fold portion 17. In addition, the fold portion 17 is fixed to be at a position at which the fold portion 17 is in contact with the fin portions 23*b* (the second fin portions 25*b*) of the fastener elements 23 by the sewing portion 12.

The sewing portion 12 with which the stringer attachment edge portion 11 of the fabric 10 and the fastener stringer 21 are sewed together is provided linearly (see FIG. 3 and FIG. 4) to extend in the front-rear direction of the fastener tape 22 by sewing in which final sewing is performed by using a sewing machine (not illustrated). Note that, in the present invention, the sewing portion with which the stringer attachment edge portion and the fastener stringer are sewed together may be formed by a substantially linear sewing portion that includes a linear portion extending in the front-rear direction of the fastener tape and a portion that is slightly bent or curved inward in the left-right direction.

The sewing portion 12 in the present example 1 is formed by a sewing thread that includes an upper thread (needle thread) and a lower thread (bobbin thread) of the sewing machine and includes a plurality of interlaced portions 13. Each of the interlaced portions 13 extends through the stringer attachment edge portion 11 of the fabric 10 and the fastener tape 22 and is formed by the upper thread and the lower thread of the sewing thread being interlaced with each other. The plurality of interlaced portions 13 are provided at regular intervals in the front-rear direction.

At least part of the interlaced portions 13 of the sewing portion 12 is provided in only gap regions 31, which are described later, formed between the fastener elements 23 of the fastener stringer 21. Consequently, the sewing portion 12 can be formed linearly or substantially linearly, and the sewing portion 12 can be in contact with a portion (a first fin portion 24*b*, which is described later) of each of the fastener elements 23. In addition, the double portion 15 of the stringer attachment edge portion 11 can be sewed, in a state of being in contact with the second fin portion 25*b* of each of the fastener elements 23, to be attached to the fastener tape 22 by the sewing portion 12 on the tape front surface (upper surface) side of the fastener tape 22.

A portion of the sewing portion 12 is disposed to be interposed between the first strip portion 16 and the second strip portion 18. In addition, the portion of the sewing portion 12 interposed between the first strip portion 16 and the second strip portion 18 is a portion of the sewing portion 12 disposed on the upper surface of the first strip portion 16.

The slide fastener 20 in the present example 1 includes the pair of left and right fastener stringers 21 in each of which an element row 27 is formed at a tape side edge portion of the fastener tape 22, and a slider 40 that is attached to the element rows 27 on the left side and the right side to be slidable. The fastener tapes 22 on the left side and the right side are each attached to a corresponding one of the stringer attachment edge portions 11 of the fabrics 10 on the left side and the right side by the sewing portion 12.

In the present example 1, the slider 40 is formed substantially similarly to the slider described in International Publication No. 2011/064893 (PTL 1) mentioned above or International Publication No. 2017/094145. The slider 40 in the present example 1 is specifically described such that the slider 40 in the present example 1 includes a slider body 41 and a pull (not illustrated) that is attached to the slider body 41.

As illustrated in FIG. 5, the slider body 41 includes an upper wing plate 42 and a lower wing plate 43 that are disposed to be separated from each other; a coupling column 44 that couples a front end portion of the upper wing plate 42 and a front end portion of the lower wing plate 43 to each other; left and right upper flanges 45 that extend from left and right side edge portions of the upper wing plate 42 toward the lower wing plate 43; left and right lower flanges 46 that extend from left and right side edge portions of the lower wing plate 43 toward the upper wing plate 42; and a pull attachment portion (not illustrated) that is integrally provided, for attachment of the pull, on the upper surface of the upper wing plate 42.

At a front end portion of the slider body 41, left and right shoulder ports are provided on the left and right sides of the coupling column 44. At a rear end portion of the slider body 41, a rear port is provided. Between the upper wing plate 42 and the lower wing plate 43 of the slider body 41, a Y-shaped element guide passage in communication with the left and right shoulder ports and the rear port is provided. Between the upper flanges 45 and the lower flanges 46 of the slider body 41, an insertion gap 47 into which the fin portions 23*b* (the first fin portions 24*b* and the second fin portions 25*b*) of the fastener elements 23 are inserted is provided. This insertion gap 47 is in communication with the element guide passage.

Note that, in the present invention, the slider body is not particularly limited as long as the slider body can cause the fastener elements 23 on the left side and the right side to engage with or separate from each other when the slider is slid along the element rows. For example, the slider body in the present invention may be formed without the upper flanges or the lower flanges in accordance with the shape and the like of the fastener elements. In this case, the insertion gap of the slider body is provided between the lower wing plate and the left and right upper flanges or between the upper wing plate and the left and the right lower flanges.

Each of the left and right fastener stringers 21 includes the fastener tape 22 that has a long and thin shape, and a plurality of the fastener elements 23 that are made of a synthetic resin and that are provided at the tape side edge portion of the fastener tape 22. Each fastener tape 22 includes a tape body portion 22*a* having a tape front surface and a tape back surface, and a core string portion 22*b* provided at a side edge of the tape body portion 22*a* on the inner side. The core string portion 22*b* is provided integrally at the side edge of the tape body portion 22*a* to extend in the tape length direction. The core string portion 22*b* is formed to protrude with respect to the tape body portion 22*a* in the up-down direction.

At the tape side edge portion of the fastener tape 22, the plurality of fastener elements 23 are provided at regular intervals in the front-rear direction and form the element row 27. Each of the fastener elements 23 is made of a synthetic resin that is injection-molded on the fastener tape 22.

Each of the fastener elements 23 includes at least an element base portion 23*a* that includes a portion whose thickness dimension is constant and the fin portion 23*b* that extends outward (in other words, toward the tape inner side of the fastener tape 22) in the left-right direction from the element base portion 23*a*.

The element base portion 23*a* is fixed to extend over the tape body portion 22*a* and the core string portion 22*b* of the fastener tape 22. Specifically, in the present example 1, the portion of the element base portion 23*a* having the constant thickness dimension is formed to extend over the tape body portion 22*a* and the core string portion 22*b* of the fastener tape 22 (see FIG. 4). The element base portion 23*a* includes at least a first body portion 24*a* and a second body portion 25*a*, which are described later, of the fastener element 23.

Here, the thickness dimension denotes the dimension in the up-down direction, and the thickness dimension of the element base portion 23*a* is the dimension of the entirety of the element base portion 23*a* from the upper surface to the lower surface thereof in the up-down direction. In the present invention, the shape and the size of the element base portion are not particularly limited as long as the element base portion includes the portion whose thickness dimension is constant.

The fin portion 23*b* is formed to have a smaller thickness dimension than the element base portion 23*a* through a step portion. The fin portion 23*b* includes the first fin portion 24*b* that is formed on the back surface of the fastener tape 22 to be on the lower surface side and the second fin portion 25*b* that is formed on the front surface of the fastener tape 22 to be on the upper surface side. Note that, in the present invention, the fin portion 23*b* may be formed by only one of the first fin portion 24*b* and the second fin portion 25*b*.

In the present example 1, due to the fastener elements 23 being each provided with the fin portion 23*b*, when the slider 40 is to be slid along the element rows 27, the upper flanges 45 and the lower flanges 46 of the slider 40 can be moved at the position of the space portion that is formed on the outer side of the step portion between the element base portion 23*a* and the fin portion 23*b* in the left-right direction.

Each of the fastener elements 23 in the present example 1 includes a first element portion 24 that is disposed on the tape back surface side of the fastener tape 22, and a second element portion 25 that is disposed on the tape front surface side of the fastener tape 22 and that has a shape different from the shape of the first element portion 24. In this case, the first element portion 24 of each of the fastener elements 23 is a portion of the slide fastener-attached garment 1 hidden on the back side of the garment 1. The second element portion 25 is a portion that is exposed to the outside of the garment 1.

As illustrated in FIG. 3, the first element portion 24 includes the first body portion 24*a* that is fixed directly to the fastener tape 22; the first fin portion 24*b* that extends outward in the left-right direction from the first body portion 24*a*; a neck portion 24*c* that extends inward in the left-right direction from the first body portion 24*a*; and an engagement head portion 24*d* that further extends inward in the left-right direction from the neck portion 24*c* and that forms a substantially elliptical shape in a bottom view of the fastener element 23.

The first body portion 24*a* forms the shape of a substantially isosceles trapezoid in a bottom view (FIG. 3) of the fastener element 23. The neck portion 24*c* has a constricted shape so as to be able to engage with the engagement head portions 24*d* of two of the fastener elements 23 that are engagement targets.

The first fin portion 24*b* extends outward in the left-right direction from the first body portion 24*a* and is formed to have a smaller thickness dimension than the first body portion 24*a* through a first step portion 24*e*. The first fin portion 24*b* includes a base end portion that is connected to the first body portion 24*a*, and a leading end portion (outside side edge portion) that is disposed on the outer side of the first fin portion 24*b* in the left-right direction.

An outside side end surface of the first fin portion 24*b* of each of the fastener elements 23, the outside side end surface facing outward in the width direction, is in contact with the sewing portion 12. Consequently, when the slider 40 is to be slid, for example, likelihood of contact between the slider 40 and the lower thread of the sewing portion 12 can be reduced, and it is thus possible to suppress wear or cut of the lower thread caused by contact between the lower thread and the slider 40. In addition, it is possible to enhance the appearance (external appearance quality) of the product.

The base end portion of the first fin portion 24*b* is formed to have a smaller dimension in the front-rear direction than the outside side edge portion of the element base portion 23*a* to which the fin portion 23*b* is connected. Further, the dimension of the first fin portion 24*b* in the front-rear direction gradually decreases from the base end portion toward the leading end portion of the fin portion 23*b*. Due to the first fin portion 24*b* being thus formed, when a sewing step, which is described later, is to be performed, the gap regions 31 in which the sewing-machine needle of the sewing machine pierces the fabric 10 and the fastener tape 22 are easily ensured to be wide. Therefore, contact of the sewing-machine needle with the fastener elements 23 is prevented or suppressed during sewing, and it is possible to cause the sewing-machine needle not to be broken easily.

Figure 7:
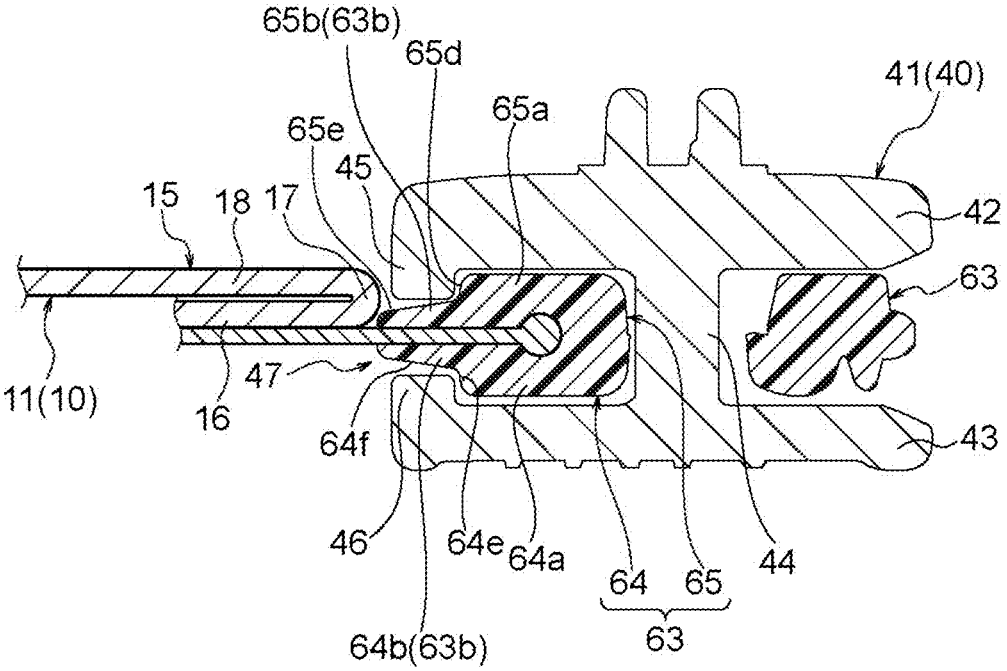
FIG. 7 is a sectional view in which a cross-section along line VII-VII indicated in FIG. 6 is schematically illustrated.

Note that the first fin portion 24*b* in the present example 1 may have a first inclined portion with which the thickness dimension of the first fin portion 24*b* is gradually decreased toward the outer side in the left-right direction as in, for example, a later-described example 2 and as illustrated in FIG. 7.

As illustrated in FIG. 2, the second element portion 25 includes the second body portion 25*a* that is fixed directly to the fastener tape 22; the second fin portion 25*b* that extends outward in the left-right direction from the second body portion 25*a*; and an element head portion 25*c* that extends inward in the left-right direction from the second body portion 25*a*. The element head portion 25*c* has a shape whose dimension in the tape length direction gradually decreases in two stages toward the leading end portion of the element head portion 25*c*.

The second fin portion 25*b* extends outward in the left-right direction from the second body portion 25*a* and is formed to have a smaller thickness dimension than the second body portion 25*a* through a second step portion 25*d*. An outside side end surface of the second fin portion 25*b* facing outward in the width direction and the stringer attachment edge portion 11 (specifically, the double portion 15) of the fabric 10 are in contact with each other. In addition, a state in which the second fin portion 25*b* of each of the fastener elements 23 and the stringer attachment edge portion 11 of the fabric 10 are in contact with each other is kept by the sewing portion 12 that is disposed linearly in the front-rear direction.

Consequently, a portion of the fastener tape 22 on the outer side of the fastener elements 23 in the left-right direction can be securely covered and hidden by the stringer attachment edge portion 11. Therefore, the fastener tape 22 can be prevented from being exposed in a range between the fastener-receiving member 10 and the fastener elements 23 in the left-right direction.

The second fin portion 25*b* of each of the fastener elements 23 in the present example 1 has a shape that is symmetrical with respect to the first fin portion 24*b* in the up-down direction with the fastener tape 22 as a reference. Therefore, the shape of the second fin portion 25*b* will be described below simply.

A base end portion of this second fin portion 25*b* is formed to have a smaller dimension in the front-rear direction than the outside side edge portion of the element base portion 23*a* to which the fin portion 23*b* is connected. The dimension of the second fin portion 25*b* in the front-rear direction gradually decreases from the base end portion toward the leading end portion of the fin portion 23*b*. Note that the second fin portion 25*b* in the present example 1 may include a second inclined portion with which the thickness dimension of the second fin portion 25*b* is gradually decreased toward the outer side in the left-right direction as in, for example, the later-described example 2 and as illustrated in FIG. 7.

The fin portion 23*b* in the present example 1 including the first fin portion 24*b* and the second fin portion 25*b* such as those described above is formed to have a thickness that enables insertion of the fin portion 23*b* into the tape insertion gap 47 of the slider 40. More specifically, in the tape insertion gap 47, the second fin portion 25*b* is insertable into a gap between the front surface of the fastener tape 22 and the lower surfaces of the upper flanges 45, and the first fin portion 24*b* is insertable into a gap between the back surface of the fastener tape 22 and the upper surfaces of the lower flanges 46. The first step portion 24*e* and the second step portion 25*d* of each of the fastener elements 23 are formed to be able to slide to come into contact with the upper flanges 45 and the lower flanges 46 of the slider 40, respectively.

Here, as illustrated in FIG. 3, in the fastener stringer 21 in the present example 1, a front-rear-direction region that is defined by the maximum space between two of the fastener elements 23 adjacent to each other in the front-rear direction on the fastener tape 22 is defined as the gap region 31. In addition, a region formed between two gap regions 31 and in which the fastener element 23 is provided is defined as an element region 32. Such gap regions 31 and element regions 32 are disposed over the entirety of the fastener stringer 21 in the left-right direction.

In at least part of a region in the front-rear direction in the fastener stringer 21 in the present example 1, the interlaced portions 13 of the sewing portion 12 are provided only in the gap regions 31 and are not provided in the element regions 32. Consequently, it is possible to form the sewing portion 12, as described above, linearly or substantially linearly in the front-rear direction and to easily cause the sewing portion 12 to be in contact with the first fin portion 24*b* of each of fastener elements 23 in the element regions 32. Further, on the upper surface side of the fastener tape 22, the stringer attachment edge portion 11 of the fabric 10 is thereby enabled to be fixed, at a position at which the stringer attachment edge portion 11 is in contact with the second fin portion 25*b* of each of the fastener elements 23, to the fastener tape 22 by the sewing portion 12.

FIG. 5 is a sectional view of the slide fastener 20 in the present example 1, in which a cross-section orthogonal to the tape length direction of the fastener tape 22 is viewed when the element rows 27 on the left side and the right side are inserted into the element guide passage of the slider 40 and in a state (under a condition) in which, at a shoulder-port-side end portion of the slider body 41, a side surface of the element base portion 23*a* of each of the fastener elements 23 facing outward in the left-right direction is not in contact with the inner wall surfaces of the upper flanges 45 and the lower flanges 46 of the slider 40. Note that, in FIG. 5, illustration of the fabric 10 (stringer attachment edge portion 11) and the sewing portion 12 is omitted for easier understanding of the relationship between the slider 40 and the fastener elements 23.

Here, the state (the state in FIG. 5) in which the side surface of the element base portion 23*a* is not in contact with the inner wall surfaces of the upper flanges 45 and the lower flanges 46 of the slider 40 denotes a normal state such as, for example, a state in which a laterally pulling force that pulls the fastener tapes 22 on the left side and the right side toward the outer side in the tape width direction is not applied to the slide fastener 20. Hereinafter, to avoid redundancy in description, a state in which, on a cross-section orthogonal to the tape length direction at the shoulder-port-side end portion of the slider body 41, the side surface of the element base portion 23*a* of each of the fastener elements 23 is not in contact with the inner wall surfaces of the upper flanges 45 and the lower flanges 46 of the slider 40 may be simply mentioned as the state in FIG. 5 or the state illustrated in FIG. 5.

In this state illustrated in FIG. 5, the side surface of the element base portion 23*a* of each of the fastener elements 23 and the inner wall surfaces of the upper flanges 45 and the lower flanges 46 of the slider 40 are disposed to be separated from each other in the tape width direction of the fastener tape 22. Note that the element base portion 23*a* may be disposed to be separated from the coupling column 44 of the slider body 41 or to be in contact with the coupling column 44.

In the state in FIG. 5, when the positional relationship of the fin portion 23*b* of each of the fastener elements 23 with respect to the upper flanges 45 and the lower flanges 46 of the slider body 41 is viewed, the fastener elements 23 in the present example 1 are formed such that leading end portions (that is, both of the leading end portion of the first fin portion 24*b* and the leading end portion of the second fin portion 25*b*) of the fin portion 23*b* are positioned on the outer side of the slider body 41 with respect to the positions of the inner wall surfaces of the upper flanges 45 and the lower flanges 46. In this case, the first step portion 24*e* and the second step portion 25*d* of each of the fastener elements 23 are positioned on the inner side of the slider body 41 with respect to the inner wall surfaces of the upper flanges 45 and the lower flanges 46.

Note that, in the present example 1, the inner wall surfaces of the upper flanges 45 are wall surfaces of the upper flanges 45 facing the element guide passage, and the inner wall surfaces of the lower flanges 46 are wall surfaces of the lower flanges 46 facing the element guide passage. In addition, outer wall surfaces of the upper flanges 45 and the lower flanges 46 are wall surfaces of the upper flanges 45 and the lower flanges 46 disposed opposite to the inner wall surfaces thereof in, for example, the tape width direction or the width direction of the slider 40.

With the fin portion 23*b* of each of the fastener elements 23 being positioned as described above with respect to the inner wall surfaces of the upper flanges 45 and the lower flanges 46 of the slider body 41 in the state in FIG. 5, the fin portion 23*b* can be stably inserted into the insertion gap 47 of the slider body 41. Consequently, the fin portion 23*b* can occupy, from the side of the element guide passage, a portion of the region of the insertion gap 47, and it is possible when the slider 40 is slid in the slide fastener 20 to cause the stringer attachment edge portion 11 (specifically, the double portion 15) of the fabric 10 not to easily enter the insertion gap 47 of the slider body 41. Further, the second fin portion 25*b* preferably has a thickness with which, in the state in FIG. 5, the second fin portion 25*b* occupies approximately 80% of a gap (in the thickness direction) between the front surface of the fastener tape 22 and the lower surfaces of the upper flanges 45 in the insertion gap 47. In addition or alternatively, the first fin portion 24*b* preferably has a thickness with which the first fin portion 24*b* occupies approximately 80% of a gap (in the thickness direction) between the back surface of the fastener tape 22 and the upper surfaces of the lower flanges 46 in the insertion gap 47. In addition or alternatively, the thickness dimension of a portion from the upper surface of the second fin portion 25*b* to the lower surface of the first fin portion 24*b* is preferably approximately 80% of the thickness dimension of the insertion gap 47. Consequently, it is possible when the slider 40 is slid in the slide fastener 20 to cause the stringer attachment edge portion 11 (specifically, the double portion 15) of the fabric 10 not to easily enter the insertion gap 47 of the slider body 41.

Accordingly, it is possible to prevent or suppress the stringer attachment edge portion 11 from being caught and engaged by the slider body 41 during sliding of the slider 40. Note that, in the state illustrated in FIG. 5, the leading end portion of the fin portion 23*b* of each of the fastener elements 23 is positioned on the inner side of the slider body 41 with respect to the outer wall surfaces of the upper flanges 45 and the lower flanges 46 of the slider body 41.

In addition, the leading end portion of the fin portion 23*b* is preferably positioned on the outer side of the slider body 41 with respect to the center position of each of the upper flanges 45 and the lower flanges 46 in the tape width direction. Consequently, it is possible to more effectively prevent or suppress the stringer attachment edge portion 11 from being caught and engaged by the slider body 41 during sliding of the slider 40.

For example, in the present example 1, the dimension of each of the upper flanges 45 and the lower flanges 46 of the slider body 41 from the inner wall surface to the outer wall surface in the tape width direction is set to 1.36 mm. In this case, the center of each of the upper flanges 45 and the lower flanges 46 in the tape width direction is disposed at a position away by 0.68 mm in the tape width direction from the inner wall surface and the outer wall surface of each of the upper flanges 45 and the lower flanges 46. In addition, in the state illustrated in FIG. 5, a distance in the tape width direction between the position of the leading end portion of the fin portion 23*b* and the position of each of the outer wall surfaces of the upper flanges 45 and the lower flanges 46 is 0.62 mm. Thus, in the present example 1, the leading end portion of the fin portion 23*b* is positioned on the outer side of the slider body 41 with respect to the center position of each of the upper flanges 45 and the lower flanges 46 in the tape width direction.

As illustrated in FIG. 1, a maximum value of dimensions of the two fastener elements 23, which are on the left side and the right side and are engaged with each other, in the tape width direction of the fastener tape 22 in a state in which a pair of the left and right element rows 27 are engaged with each other is defined as "element maximum width W1" in the present example 1. In addition, a total of dimensions W2 of the fin portions 23*b* of these two fastener elements 23 in the tape width direction is defined as "total fin width".

When the element maximum width W1 and the total fin width are defined as described above, the fin portion 23*b* in the present example 1 is formed to have a size with which the ratio of the total fin width to the element maximum width W1 is less than 40%. For example, the element maximum width W1 and the total fin width of each of the fastener elements 23 in the present example 1 is 7.61 mm and 2 mm, respectively. Thus, the ratio of the total fin width to the element maximum width W1 is 26%.

With the fastener elements 23 each including the fin portion 23*b* in which the ratio of the total fin width to the element maximum width W1 is less than 40%, the fin portion 23*b* is prevented from being elongated excessively in the tape width direction, and the influence of the fin portion 23*b* on the appearance and the external appearance quality of the slide fastener 20 and the slide fastener-attached garment 1 can be suppressed to be small. It is thus possible to easily manufacture the garment 1 having excellent design characteristics or high external appearance quality.

In the present invention, the shape of each of the fastener elements 23 other than the shape of the fin portion 23*b* is not particularly limited, and each of the fastener elements 23 may have any shape as long as the shape enables engagement of the element rows 27 on the left side and the right side. For example, each of the fastener elements may have a shape with which the entirety of the fastener element is symmetrical in the up-down direction with the fastener tape as a reference.

Next, a method of manufacturing the slide fastener-attached garment 1 by attaching the fastener stringer 21 of the slide fastener 20 to the stringer attachment edge portion 11 of the fabric 10 will be described.

First, a sewing step (sewing) in which the fastener tape 22 of the fastener stringer 21 and the stringer attachment edge portion 11 of the fabric 10 are sewed together by using a sewing machine is performed.

Note that, in the following description regarding the sewing machine and the sewing step, the front-rear direction is a conveyance direction of the sewing machine and is a direction along a direction in which the fastener stringer 21 and the fabric 10, which are sewing targets, are fed. In this case, a direction in which the sewing targets are fed is the forward direction, and a direction opposite thereto is the rearward direction. The up-down direction is a direction along a direction in which a sewing-machine needle of the sewing machine reciprocates. In this case, a direction in which the sewing-machine needle is caused to pierce the sewing targets is the downward direction, and a direction in which the sewing-machine needle is extracted from the sewing targets is the upward direction. The left-right direction is a direction that is orthogonal to the direction of feeding the sewing targets and that is orthogonal to the direction in which the sewing-machine needle reciprocates.

The sewing machine (not illustrated) used in the sewing step in the present example 1 includes a needle plate on which the sewing targets are to be placed; a needle bar that is supported to be able to reciprocate with respect to the needle plate in the up-down direction; a sewing-machine needle that is held by the needle bar; a sewing-machine presser foot that presses the sewing targets toward the needle plate; a conveyance gear that conveys the fastener stringer 21; and a pot portion that is provided below the needle plate. In this case, the needle bar, the sewing-machine needle, the sewing-machine presser foot, and the pot portion of the sewing machine are each formed substantially similarly to a needle bar, a sewing-machine needle, a sewing-machine presser foot, and a pot portion that are employed in an existing general sewing machine.

The needle plate includes a base portion that has a flat surface, and a guide groove portion that is provided to be recessed with respect to the flat surface of the base portion. The guide groove portion is formed continuous in the front-rear direction so that the element row 27 of the fastener stringer 21 can be inserted into the guide groove portion to be guided.

The conveyance gear is formed by a spur gear that has an outer peripheral portion provided with a plurality of teeth. The pitch of the teeth of the conveyance gear is set to the same size as a formed pitch in the front-rear direction of the fastener elements 23 forming the element row 27 or set to be slightly larger than the formed pitch.

The conveyance gear is disposed to extend in the front-rear direction of the sewing machine, and a rotary shaft of the conveyance gear is held at a position below the needle plate by a gear holder, which is not illustrated. The conveyance gear is rotated by a rotary drive portion, which is not illustrated, including a servo motor or a stepping motor. In addition, the conveyance gear is disposed at a position at which at least one of teeth of the conveyance gear protrudes constantly in the guide groove portion.

To perform the sewing step that includes sewing in which the fastener stringer 21 is sewed and attached to the fabric 10 by using the above-described sewing machine, the element row 27 of the fastener stringer 21 is first introduced into the guide groove portion of the needle plate, and the fastener tape 22 is placed on the base portion of the needle plate. At this time, the element row 27 is engaged with the teeth of the conveyance gear protruding in the guide groove portion of the needle plate.

Further, the fabric 10 is placed on the needle plate while being aligned with respect to the fastener stringer 21 such the fabric 10 covers the fastener stringer 21 from above.

Thereafter, the sewing-machine presser foot is lowered to thereby cause the fastener stringer 21 and the fabric 10 to be interposed and held between the sewing-machine presser foot and the needle plate. At this time, the stringer attachment edge portion 11 of the fabric 10 is held in a flat state while the U-shaped double portion 15 has not been formed yet at the stringer attachment edge portion 11.

Next, the sewing machine is operated to thereby cause the conveyance gear to rotate to convey the fastener stringer 21 and cause the sewing-machine needle to move upward and downward in the up-down direction. At this time, the fabric 10 is conveyed together with the fastener stringer 21. Consequently, final sewing can be performed by the sewing-machine needle piercing the fabric 10 and the fastener tape 22, and the sewing portion 12 formed by the sewing thread (the upper thread and the lower thread) is thus formed linearly or substantially linearly in the front-rear direction while the fabric 10 and the fastener tape 22 are sewed together with the sewing portion 12.

Here, a position (needle-lowering position) at which the sewing-machine needle is caused to pierce the fabric 10 and the fastener tape 22 will be described. In the present example, the sewing-machine needle is caused to pierce the fabric 10 and the fastener tape 22 at, in the fastener stringer 21, a position in the above-described gap region 31 formed between the fastener elements 23 in the front-rear direction. In addition, in the left-right direction, the needle-lowering position of the sewing-machine needle is set to a position on the outer side in the left-right direction with respect to the fin portion 23*b* of each of the fastener elements 23 or set to a position at which at least a portion overlaps an outside side edge portion of the fin portion 23*b*.

In this case, the needle-lowering position of the sewing-machine needle is preferably set to a central portion between two of the fastener elements 23 that are adjacent to each other in the front-rear direction. Note that the needle-lowering position is not limited to be set at the central portion between the fastener elements 23 and may be set to a position closer to one of the two fastener elements 23 as long as the position is in the gap region 31. In addition, the needle-lowering position may be only one position or two or more positions in each of the gap regions 31.

By causing the sewing-machine needle to pierce the fabric 10 and the fastener tape 22 at the needle-lowering position such as that described above, it is possible to prevent the sewing-machine needle reciprocating vertically from coming into contact with the fastener elements 23 during sewing. It is also possible to stably form the linear or substantially linear sewing portion 12 in the sewing step and possible to cause the sewing portion 12 to be in contact with the outside side end surface of the first fin portion 24*b* of each of the fastener elements 23.

In this case, it is possible to stably convey the fastener stringer 21 while precisely controlling the position of the fastener stringer 21 by the conveyance gear since the conveyance gear rotates while constantly engaging with the fastener stringer 21 in the sewing machine (not illustrated) in the present example. As a result, it is possible to suppress a change in the pitch of the fastener elements 23 in response to the vertical movement of the sewing-machine needle. In addition, it is possible to control the vertical movement of the sewing-machine needle and the rotation of the conveyance gear to match with each other and thus is possible to easily adjust the position at which the sewing-machine needle pierces the fastener tape 22.

Note that, while the conveyance gear in the present example engages with the fastener stringer 21 from the lower side of the fastener stringer 21, the conveyance gear may engage with the fastener stringer 21 in a crosswise direction (for example, the width direction of the sewing machine) of the fastener stringer 21.

By performing sewing such as that described above, it is possible to form the sewing portion 12 in which the interlaced portions 13 are provided in only the gap regions 31 of the fastener stringer 21 and possible to sew the fastener tape 22 of the fastener stringer 21 and the stringer attachment edge portion 11 of the fabric 10 to each other.

After the above-described sewing step is performed, a folding step in which the stringer attachment edge portion 11 of the fabric 10 is folded to form the double portion 15 is performed.

In this folding step, the stringer attachment edge portion 11 of the fabric 10 is folded along the linearly or substantially linearly formed sewing portion 12 such that the first strip portion 16 and the second strip portion 18, which are described above, of the stringer attachment edge portion 11 overlap each other vertically. Consequently, the double portion 15 is formed at the stringer attachment edge portion 11 of the fabric 10, and the fabric 10 to which the fastener stringer 21, such as that illustrated in FIG. 2 to FIG. 4, is sewed and attached is manufactured.

At this time, the fastener stringer 21 is sewed and attached to the first strip portion 16 of the double portion 15, and the fold portion 17 of the double portion 15 is in contact with the fin portion 23*b* (second fin portion 25*b*) of each of the fastener elements 23. Further, a portion of the sewing portion 12 is held in a state of being wrapped by the double portion 15. The second strip portion 18 of the double portion 15 is disposed on the upper side of the sewing portion 12 so as to cover the sewing portion 12, and the sewing portion 12 is thus hidden by the second strip portion 18 and is not visible from the upper surface (outer surface) side of the stringer attachment edge portion 11.

In addition, in the present example 1, the thickness dimension of the entirety of the double portion 15 in the up-down direction is preferably larger than that of the space of the insertion gap 47 provided at the slider body 41.

Consequently, it is possible to further cause the double portion 15 of the stringer attachment edge portion 11 not to easily enter the insertion gap 47 of the slider body 41 and thus is possible to effectively prevent or suppress the stringer attachment edge portion 11 from being caught and engaged by the slider body 41.

Thereafter, two fabrics 10 to each of which the fastener stringer 21 is sewed and attached are combined together into one set, and the slider 40 is attached to the element rows 27 of the fastener stringers 21 of the one set, thereby manufacturing the fabrics 10 to which the slide fastener is attached. By forming the garment 1 with the fabrics 10 to which the slide fastener is attached, the slide fastener-attached garment 1 is manufactured.

In the present invention, the method of manufacturing the slide fastener-attached garment 1 is not particularly limited.

In the slide fastener-attached garment 1 in the present example 1 manufactured as described above, the linear or substantially linear sewing portion 12 with which the fastener stringer 21 and the fabric 10 are sewed together can be stably in contact with the first fin portion 24*b* of each of the fastener elements 23 (see FIG. 2 and FIG. 4). In addition, on the front surface side of the garment 1, the position of the stringer attachment edge portion 11 (specifically, the double portion 15) of the fabric 10 is thereby fixed as illustrated in, for example, FIG. 4 by the sewing portion 12, and it is thus possible to stably keep a state in which the stringer attachment edge portion 11 is in contact with the second fin portion 25*b* of each of the fastener elements 23. As a result, the fastener tape 22 can be prevented from being exposed to the outside between the fabric 10 and the fastener elements 23 in the left-right direction.

In addition, in the slide fastener 20 in the present example 1, the fin portion 23*b* of each of the fastener elements 23 is formed to be short in the left-right direction such that the ratio of the total fin width to the above-described element maximum width W1 is less than 40%. Consequently, the influence of the fin portions 23*b* of the fastener elements 23 on the appearance and the external appearance quality of the slide fastener 20 and the slide fastener-attached garment 1 can be suppressed to be small. Further, it is also possible to reduce the size of a tape portion exposed between the fastener elements 23 that are adjacent to each other in the front-rear direction of the fastener tape 22.

Thus, according to the garment 1 to which the slide fastener 20 in the present example 1 is attached, it is possible to reduce a portion where the fastener tape 22 is exposed to the outside. In addition, in the external appearance of the slide fastener 20, the fin portions 23*b* of the fastener elements 23 can be hardly recognizable. Consequently, it is possible to cause the design characteristics, the external appearance quality, and the like of the garment 1 not to be easily ruined by the fastener tape 22 and the fastener elements 23, and thus, the slide fastener-attached garment 1 can have excellent design characteristics or high external appearance quality.

Further, when the slide fastener 20 is held in the state illustrated in FIG. 5, the leading end portions of the fin portions 23*b* of the fastener elements 23 are positioned, as described above, on the outer side of the slider body 41 with respect to the inner wall surfaces of the upper flanges 45 and the lower flanges 46 of the slider body 41. Specifically, in the present example 1, the leading end portions of the fin portions 23*b* are positioned on the outer side of the slider body 41 with respect to the center position of each of the upper flanges 45 and the lower flanges 46 in the tape width direction.

Consequently, even when the fin portions 23*b* of the fastener elements 23 and the stringer attachment edge portion 11 of the fabric 10 are in contact with each other as in the present example 1, it is possible since the fin portions 23*b* are inserted into the insertion gap 47 of the slider body 41 and partially fill the space portion of the insertion gap 47 to cause the stringer attachment edge portion 11 of the fabric 10 not to easily enter the insertion gap 47 of the slider body 41.

Accordingly, it is possible to prevent or suppress the stringer attachment edge portion 11 from being caught and engaged by the slider body 41 during sliding of the slider 40. Thus, even when an exposed portion of the fastener tape 22 is reduced by bringing the stringer attachment edge portion 11 and the fastener elements 23 in contact with each other as described above, it is possible to stably ensure appropriate operability of the slider 40 and possible to cause the slider 40 to slide smoothly along the element rows 27.

Example 2

Figure 6:
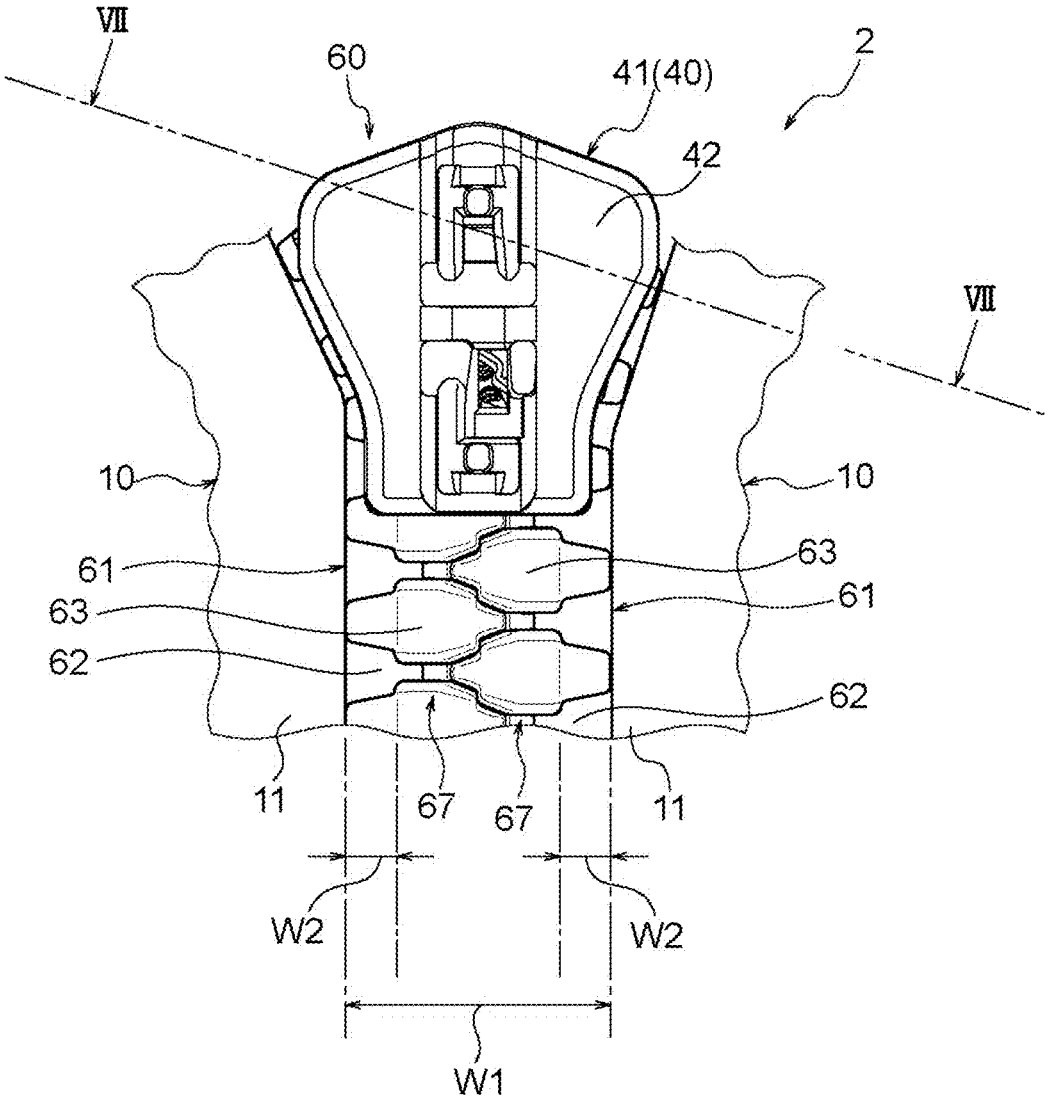
FIG. 6 is a plan view in which principal part of a slide fastener-attached product according to an example 2 of the present invention is schematically illustrated.

FIG. 6 is a plan view in which principal part of a slide fastener-attached product according to the present example 2 is schematically illustrated. FIG. 7 is a sectional view in which a cross-section along line VII-VII indicated in FIG. 6 is schematically illustrated. Note that illustration of a sewing portion is omitted in FIG. 7.

A slide fastener-attached product 2 in the present example 2 is a garment 2, as in the example 1 described above. The slide fastener-attached garment 2 in the present example 2 includes a slide fastener 60 that includes a pair of left and right fastener stringers 61, and a fastener-receiving member 10 (fabric 10) that includes left and right stringer attachment edge portions 11 to which the left and right fastener stringers 61 are attached, respectively.

The slide fastener-attached garment 2 in the present example 2 is formed to differ from the slide fastener-attached garment 1 described in the above-described example 1 in terms of the shape and the size of a fin portion 63*b* of each fastener element 63. Note that the slide fastener-attached garment 2 in the present example 2 is formed substantially similarly, except the difference in the above-described fin portion 63*b*, to the slide fastener-attached garment 1 described in the above-described example 1.

Therefore, detailed description of portions, members, and the like that are formed substantially similarly to those of the slide fastener-attached garment 1 described in the above-described example 1 is omitted in description regarding the present example 2 by indicating those with the same signs as those in the above-described example 1.

The slide fastener 60 in the present example 2 includes the pair of left and right fastener stringers 61 in each of which an element row 67 is formed at a tape side edge portion of the fastener tape 22, and the slider 40 that is attached to the element rows 67 on the left side and the right side to be slidable. In the present example 2, the fastener tapes 22 on the left side and the right side are each attached to a corresponding one of the stringer attachment edge portions 11 of the fabrics 10 on the left side and the right side by a sewing portion (not illustrated) similar to that in the example 1 described above.

Each of the fastener stringers 61 on the left side and the right side includes the fastener tape 22 and a plurality of the fastener elements 63 that are made of a synthetic resin and that form the element row 67. Each fastener element 63 includes at least an element base portion 63*a* that includes a portion whose thickness dimension is constant and the fin portion 63*b* that extends outward in the left-right direction from the element base portion 63*a*.

The fin portion 63*b* is formed to have a smaller thickness dimension than the element base portion 63*a* through a step portion and includes a first fin portion 64*b* that is formed on the back surface side of the fastener tape 22 to be on the lower surface and a second fin portion 65*b* that is formed on the front surface of the fastener tape 22 to be on the upper surface side. The first fin portion 64*b* and the second fin portion 65*b* of the fin portion 63*b* have shapes that are symmetrical to each other in the up-down direction with the fastener tape 22 as a reference. The fin portion 63*b* including the first fin portion 64*b* and the second fin portion 65*b* is formed to have a thickness that enables insertion of the fin portion 63*b* into the tape insertion gap 47 of the slider 40.

Each fastener element 63 in the present example 2 includes a first element portion 64 that is disposed on the tape back surface side of the fastener tape 22 and a second element portion 65 that is disposed on the tape front surface side of the fastener tape 22.

The first element portion 64 includes a first body portion 64*a* that is fixed to the fastener tape 22; the first fin portion 64*b* that extends outward in the left-right direction from the first body portion 64*a*; a neck portion (not illustrated) that extends inward in the left-right direction from the first body portion 64*a*; and an engagement head portion (not illustrated) that further extends inward in the left-right direction from the neck portion.

The first fin portion 64*b* extends outward in the left-right direction from the first body portion 64*a* and is formed to have a smaller thickness dimension than the first body portion 64*a* through a first step portion 64*e*. An outside side end surface of this first fin portion 64*b* facing outward in the width direction is in contact with the sewing portion.

A base end portion of the first fin portion 64*b* is formed to have a smaller dimension in the front-rear direction than an outside side edge portion of the element base portion 63*a*. Further, the dimension of the first fin portion 64*b* in the front-rear direction gradually decreases from a base end portion toward a leading end portion of the fin portion 63*b*. Due to the first fin portion 64*b* being formed as described above, it is possible to easily ensure a wide gap region in which a sewing-machine needle of a sewing machine is caused to pierce the fabric 10 and the fastener tape 22 in a sewing step.

As illustrated in FIG. 7, the first fin portion 64*b* in the present example 2 includes a first inclined portion 64*f* that gradually decreases the thickness dimension of the first fin portion 64*b* toward the outer side in the left-right direction. For example, even if the sewing portion (the lower thread) is temporarily placed to overlap the first fin portion 64*b* in the up-down direction when sewing is performed, the sewing portion is caused by this first inclined portion 64*f* to move outward in the left-right direction, and the sewing portion can be easily disposed on the outer side of the first fin portion 64*b* in the left-right direction. In addition, as a result, the sewing portion can be easily caused to be in contact with the outside side end surface of the first fin portion 64*b*.

As illustrated in FIG. 2, the second element portion 65 includes a second body portion 65*a* that is fixed directly to the fastener tape 22; the second fin portion 65*b* that extends outward in the left-right direction from the second body portion 65*a*; and an element head portion that extends inward in the left-right direction from the second body portion 65*a*.

The second fin portion 65*b* extends outward in the left-right direction from the second body portion 65*a* and is formed to have a smaller thickness dimension than the second body portion 65*a* through a second step portion 65*d*. An outside side end surface of the second fin portion 65*b* facing outward in the width direction and the stringer attachment edge portion 11 (specifically, the double portion 15) of the fabric 10 are in contact with each other. A state in which the second fin portion 65*b* of each of the fastener elements 63 and the stringer attachment edge portion 11 of the fabric 10 are in contact with each other is kept by the sewing portion that is formed to extend in the front-rear direction.

The second fin portion 65*b* of each of the fastener elements 63 in the present example 2 has a shape that is symmetrical to the first fin portion 64*b* in the up-down direction with the fastener tape 22 as a reference. The base end portion of the second fin portion 65*b* is thus formed to have a smaller dimension in the front-rear direction than the outside side edge portion of the element base portion 63*a*. In addition, the dimension of the second fin portion 65*b* in the front-rear direction gradually decreases from the base end portion toward the leading end portion of the fin portion 63*b*.

The second fin portion 65*b* in the present example 2 includes a second inclined portion 65*e* that gradually decreases the thickness dimension of the second fin portion 65*b* toward the outer side in the left-right direction. Consequently, it is possible to cause the first strip portion 16 of the double portion 15 not to easily overlap the second fin portion 65*b* in the up-down direction by being placed above the second fin portion 65*b*.

FIG. 7 is a sectional view of the slide fastener 60 in the present example 2, in which a cross-section orthogonal to the tape length direction of the fastener tape 22 is viewed in a state in which, while the element rows 67 on the left side and the right side are inserted into the element guide passage of the slider 40, a side surface of the element base portion 63*a* of each of the fastener elements 63 facing outward in the left-right direction is not in contact at the shoulder-port-side end portion of the slider body 41 with the inner wall surfaces of the upper flanges 45 and the lower flanges 46 of the slider 40. In addition, such a state described above may be simply mentioned as the state in FIG. 7 or the state illustrated in FIG. 7 in the present example 2 as in the above-described example 1.

In this state illustrated in FIG. 7, when the positional relationship of the fin portion 63*b* of each of the fastener elements 63 with respect to the upper flanges 45 and the lower flanges 46 of the slider body 41 is viewed, the fastener elements 63 in the present example 2 are formed such that the leading end portion of the fin portion 63*b* is positioned on the outer side of the slider body 41 with respect to the inner wall surfaces of the upper flanges 45 and the lower flanges 46. In this case, the first step portion 64*e* and the second step portion 65*d* of each of the fastener elements 63 are positioned on the inner side of the slider body 41 with respect to the inner wall surfaces of the upper flanges 45 and the lower flanges 46.

Further, in the present example 2, the leading end portion of the fin portion 63*b* is formed to be positioned, in the state illustrated in FIG. 7, on the outer side of the slider body 41 with respect to the outer wall surfaces of the upper flanges 45 and the lower flanges 46. That is, the fin portion 63*b* in the present example 2 is formed to extend further from the element base portion 63*a* in the tape width direction than the fin portion 23*b* in the above-described example 1.

With the fin portion 63*b* being formed as described above to be positioned on the outer side of the slider body 41 with respect to the outer wall surfaces of the upper flanges 45 and the lower flanges 46, it is possible to stably prevent the stringer attachment edge portion 11 (double portion 15) of the fabric 10 from entering the insertion gap 47 of the slider body 41 when the slider 40 is slid in the slide fastener 60.

In addition, when the element maximum width W1 and the total fin width are defined in the present example 2 as in the above-described example 1, the fin portion 63*b* in the present example 2 is formed to have a size with which the ratio of the total fin width to the element maximum width W1 is less than 40%. This is specifically described such that the ratio of the total fin width to the element maximum width W1 is 38% in the present example 2. Consequently, the fin portion 63*b* is prevented from being excessively elongated in the tape width direction, and the influence of the fin portion 63*b* on the appearance and the external appearance quality of the slide fastener 60 and the slide fastener-attached garment 2 can be suppressed to be small.

The slide fastener-attached product 2 in such a present example 2 can be manufactured by a method substantially similar to the method for manufacturing the slide fastener-attached product 1 in the above-described example 1.

In the slide fastener-attached garment 2 in the present example 2 described above, the position of the stringer attachment edge portion 11 of the fabric 10 is fixed by the sewing portion with which the fastener stringer 61 and the fabric 10 are sewed together, and a state in which the stringer attachment edge portion 11 is in contact with the second fin portion 65*b* of each of the fastener elements 63 can be stably kept. Consequently, it is possible to prevent the fastener tape 22 from being exposed to the outside between the fabric 10 and the fastener elements 63 in the left-right direction.

Further, the fin portion 63*b* of each fastener element 63 is formed such that the ratio of the total fin width to the above-described element maximum width W1 is less than 40%. Thus, the influence of the fin portion 63*b* of the fastener element 63 on the appearance and the external appearance quality of the slide fastener 60 and the slide fastener-attached garment 2 can be suppressed to be small. Therefore, according to the slide fastener-attached garment 2 in the present example 2, it is possible to cause the design characteristics, the external appearance quality, and the like of the garment 2 not to be easily ruined by the fastener tape 22 and the fastener elements 63.

Further, when the slide fastener 60 is held in the state illustrated in FIG. 7, the leading end portion of the fin portion 63*b* of each of the fastener elements 63 is positioned on the outer side of the slider body 41 with respect to the outer wall surfaces of the upper flanges 45 and the lower flanges 46 of the slider body 41.

Consequently, even when the fin portion 63*b* of each of the fastener elements 63 and the stringer attachment edge portion 11 of the fabric 10 are in contact with each other as in the present example 2, it is possible to inhibit the stringer attachment edge portion 11 of the fabric 10 from entering the insertion gap 47 of the slider body 41 and thus is possible to stably prevent the stringer attachment edge portion 11 from being caught and engaged by the slider body 41 during sliding of the slider 40.

Note that, on the back surface side of the garment 1 or 2, the sewing portion 12 is provided in contact with the first fin portion 24*b* or 64*b* of each of the fastener elements 23 or 63 in the example 1 and the example 2 described above. In the present invention, however, the sewing portion may be provided on the back surface side of the garment to be at a position that is slightly separated from the first fin portion of each of the fastener elements. Even in this case, it is possible on the front surface side of the garment to fix the position of the stringer attachment edge portion (double portion) by the sewing portion and keep a state in which the stringer attachment edge portion is in contact with or close to the second fin portion of each of the fastener elements. It is thus possible to prevent or suppress exposure of the fastener tape to the outside between the fabric and the fastener elements.

Note that the present invention is not limited to the example 1 and the example 2 described above and various modifications are possible as long as each modification has a configuration that is substantially the same as that of the present invention and exerts similar effects.

For example, in each of the slide fastener 20 and the slide fastener 60 in the example 1 and the example 2, the fastener elements 23 and 63 are each formed into an independent shape by injection molding of a synthetic resin and are provided at the fastener tape 22. In the prevent invention, however, the fastener stringer and the slide fastener may be formed by providing the fastener tape with, instead of the fastener elements made of a synthetic resin, a plurality of metallic fastener elements each having an independent shape.

REFERENCE SIGNS LIST

1, 2 slide fastener-attached garment (slide fastener-attached product)
10 fastener-receiving member (fabric)
11 stringer attachment edge portion
12 sewing portion
13 interlaced portion
15 double portion
16 first strip portion
17 fold portion
18 second strip portion
20 slide fastener
21 fastener stringer
22 fastener tape
22*a* tape body portion
22*b* core string portion
23 fastener element
23*a* element base portion
23*b* fin portion
24 first element portion
24*a* first body portion
24*b* first fin portion
24*c* neck portion
24*d* engagement head portion
24*e* first step portion
25 second element portion
25*a* second body portion
25*b* second fin portion
25*c* element head portion
25*d* second step portion
27 element row
31 gap region
32 element region
40 slider
41 slider body
42 upper wing plate
43 lower wing plate
44 coupling column
45 upper flange
46 lower flange
47 insertion gap
60 slide fastener
61 fastener stringer
63 fastener element
63*a* element base portion
63*b* fin portion
64 first element portion
64*a* first body portion
64*b* first fin portion
64*e* first step portion
64*f* first inclined portion
65 second element portion
65*a* second body portion
65*b* second fin portion
65*d* second step portion
65*e* second inclined portion
67 element row
W1 element maximum width
W2 dimension of fin portion in tape width direction

The invention claimed is:

1. A slide fastener comprising: a pair of fastener stringers in each of which a plurality of fastener elements are provided at a fastener tape to form an element row; and a slider that is attached to the element rows to be slidable, wherein the slider includes a slider body, the slider body including an upper wing plate and a lower wing plate that are disposed to be separated from each other, a coupling column that couples the upper wing plate and the lower wing plate to each other, and a flange that extends from a side edge portion of at least one of the upper wing plate and the lower wing plate, the slider body is provided with an element guide passage that is formed into a Y-shape between the upper wing plate and the lower wing plate, a pair of shoulder ports that are each provided at a side of the coupling column such that the coupling column is interposed between the pair of shoulder ports, and an insertion gap that is provided at a side edge portion of the slider body and that is in communication with the element guide passage, each of the fastener elements includes an element base portion including a portion whose dimension in a tape thickness direction of the fastener tape is constant, and a fin portion extending from the element base portion toward a tape inner side of the fastener tape and having a smaller dimension in the tape thickness direction than the element base portion through a step portion, when, at a shoulder-port-side end portion of the slider body with the element guide passage into which the element rows are inserted, a cross-section orthogonal to a tape length direction of the fastener tape is viewed, a leading end portion of the fin portion is positioned on an outer side of the slider body with respect to an inner wall surface of the flange in a state in which a side surface of the element base portion of each of the fastener elements, the side surface facing outward in a left-right direction, is not in contact with the inner wall surface of the flange of the slider, and in a state in which a pair of the element rows are engaged with each other, when a maximum value of a dimension of two of the fastener elements that are engaged with each other in a tape width direction of the fastener tape is defined as an element maximum width and a total of dimensions of the fin portions of the two of the fastener elements in the tape width direction is defined as a total fin width, a ratio of the total fin width to the element maximum width is less than 40%.

2. The slide fastener according to claim 1, wherein when, at the shoulder-port-side end portion of the slider body, the cross-section orthogonal to the tape length direction of the fastener tape is viewed, the leading end portion of the fin portion is positioned on the outer side of the slider body with respect to a center position of the flange in the tape width direction in the state in which the side surface of the element base portion of each of the fastener elements, the side surface facing outward in the left-right direction, is not in contact with the inner wall surface of the flange of the slider.

3. The slide fastener according to claim 1, wherein a dimension of the fin portion in the tape length direction gradually decreases toward the leading end portion of the fin portion.

4. The slide fastener according to claim 1, wherein a dimension of a base end portion of the fin portion in the tape length direction is smaller than a dimension of a side edge portion of the element base portion in the tape length direction, the side edge portion being on a side to which the fin portion is connected.

5. The slide fastener according to claim 1, wherein a dimension of the fin portion in the tape thickness direction of the fastener tape gradually decreases toward the leading end portion of the fin portion.

6. A slide fastener-attached product comprising:

the slide fastener according to claim 1; and a fastener-receiving member, in which the fastener stringers are attached to a stringer attachment edge portion by a sewing portion formed by a sewing thread.

7. The slide fastener-attached product according to claim 6, wherein the stringer attachment edge portion includes a double portion that is folded into a U-shape in a sectional view orthogonal to the tape length direction, the double portion in the sectional view includes a first strip portion, at least a portion of which is in contact with the fastener tape, a fold portion that extends from the first strip portion and that has a folded shape, and a second strip portion that extends from the fold portion and that is disposed to overlap the first strip portion, a portion of the sewing portion is disposed to be interposed between the first strip portion and the second strip portion of the double portion, and the double portion is fixed, at a position at which the double portion is in contact with at least a portion of each of the fastener elements, to the fastener tape by the sewing portion.

8. The slide fastener-attached product according to claim 7, wherein a dimension of the double portion in the tape thickness direction is larger than a dimension of a space of the insertion gap of the slider.

* * * * *